US007631510B2

(12) United States Patent
Radermacher et al.

(10) Patent No.: US 7,631,510 B2
(45) Date of Patent: Dec. 15, 2009

(54) MULTI-STAGE REFRIGERATION SYSTEM INCLUDING SUB-CYCLE CONTROL CHARACTERISTICS

(75) Inventors: Reinhard Radermacher, Silver Spring, MD (US); Toshikazu Ishihara, Saitama (JP); Hans Huff, West Hartford, CT (US); Yunho Hwang, Ellicott City, MD (US); Masahisa Otake, Ora-machi (JP); Hiroshi Mukaiyama, Chiyoda-machi (JP); Osamu Kuwabara, Oizumi-machi (JP); Ichiro Kamimura, Gunma (JP)

(73) Assignees: Thermal Analysis Partners, LLC., College Park, MD (US); Sanyo Electric Co., Ltd., Osaka (JP)

( * ) Notice: Subject to any disclaimer, the term of this patent is extended or adjusted under 35 U.S.C. 154(b) by 453 days.

(21) Appl. No.: 11/066,560

(22) Filed: Feb. 28, 2005

(65) Prior Publication Data

US 2006/0191288 A1 Aug. 31, 2006

(51) Int. Cl.
*F25B 41/00* (2006.01)

(52) U.S. Cl. ..... 62/196.2; 62/510; 62/513

(58) Field of Classification Search ..... 62/510, 62/116, 172, 513, 498, 196.4, 113, 196.2
See application file for complete search history.

(56) References Cited

U.S. PATENT DOCUMENTS 4,918,942 A * 4/1990 Jaster ..... 62/335
6,321,564 B1 * 11/2001 Yamanaka et al. ..... 62/510
6,568,198 B1 5/2003 Tadano et al.
2003/0106330 A1 * 6/2003 Yamasaki et al. ..... 62/196.4

FOREIGN PATENT DOCUMENTS

CN 1171050 C 10/2004
JP 2002-327690 11/2002

OTHER PUBLICATIONS

Chinese Office Action with English Translation issued in Chinese Patent Application No. 200610079440.6 dated May 30, 2008.

* cited by examiner

*Primary Examiner*—William E Tapolcai
(74) *Attorney, Agent, or Firm*—McDermott Will & Emery LLP

(57) ABSTRACT

A multi-stage refrigeration system is provided. The refrigeration system includes a first compression element which produces a first compressed refrigerant stream. A mixer combines the first compressed refrigerant stream with an auxiliary refrigerant stream. A second compression element is coupled to the mixer and produces a second compressed refrigerant stream. A first heat exchanger receives the second compressed refrigerant stream and generates a cooled stream. A stream splitter receives the cooled stream and provides first and second output streams. A first expansion valve receives the first output stream and controls the flow of the first output stream and a second expansion valve receives the second output stream and controls the flow of the second output stream. A second heat exchanger generates the auxiliary refrigerant stream provided to the mixer. An evaporator is coupled to the first expansion valve and the first compression element to evaporate the first output stream and provide an evaporated stream to the first compression element.

3 Claims, 14 Drawing Sheets

(a) Sub-Cycle (b) Main-Cycle

1. Orifice Area

3. Relationship between Intermediate Pressure Coefficients and COP

Figure 3 shows the optimized intermediate pressure coefficient for various conditions. This figure indicates that the optimized intermediate pressure coefficient ranges between 1.2 and 1.3. Figure 4 shows the relationship between the optimized intermediate pressure coefficient and COP.

MULTI-STAGE REFRIGERATION SYSTEM INCLUDING SUB-CYCLE CONTROL CHARACTERISTICS

TECHNICAL FIELD

This invention relates generally to refrigeration systems, and more particularly, to a multi-stage refrigeration system having main and auxiliary refrigerant streams regulated by control characteristics.

BACKGROUND

A typical multi-stage refrigeration device includes a main refrigerant stream and one or more sub-cycle or auxiliary refrigerant streams. A multi-stage refrigeration device may have improved efficiency compared to a single-stage device because the auxiliary stream cools the main stream while maintaining the high pressure of the main stream (i.e., lower pressure on the suction side makes the compressor work harder). However, the effectiveness of the auxiliary stream in precooling the main stream depends on the performance of the intermediate heat exchanger. In this regard, what is needed is a control methodology to regulate the auxiliary expansion value that controls the flow rate intermediate heat exchanger.

SUMMARY

In one aspect, a refrigerating apparatus includes a compression element, radiator, auxiliary expansion means, intermediate heat exchanger, main expansion means and evaporator constitute a refrigeration cycle, refrigerant flowing out of said radiator is branched into two streams. The first refrigerant stream is passed to the first flow path of the intermediate heat exchanger via said auxiliary expansion means, the second refrigerant stream is passed to the second flow path of the intermediate heat exchanger and then to the evaporator via said main expansion means. Heat exchange is performed between the two refrigerant stream within said intermediate heat exchanger, the refrigerant flowing out of said evaporator is sucked by low pressure part of said compression element, and the refrigerant flowing out of said intermediate heat exchanger is sucked by intermediate pressure part of said compression element. The pressure in said intermediate pressure part of said compression element is determined by controlling said auxiliary expansion means in accordance with the pressure of the suction side and the discharge side of said compression element.

In another aspect, a refrigerating apparatus includes a compression element, radiator, auxiliary expansion means intermediate heat exchanger, main expansion means and evaporator constitute a refrigeration cycle, refrigerant flowing out of said radiator is branched into two streams. The first refrigerant stream is passed to the first flow path of the intermediate heat exchanger via said auxiliary expansion means, the second refrigerant stream is passed to the second flow path of the intermediate heat exchanger and then to the evaporator via said main expansion means. Heat exchange is performed between the two refrigerant stream within said intermediate heat exchanger, the refrigerant flowing out of said evaporator is sucked by low pressure part of said compression element, and the refrigerant flowing out of said intermediate heat exchanger is sucked by intermediate pressure part of said compression element. The pressure in said intermediate pressure part of the compression element is controlled to an optimum intermediate pressure by controlling said auxiliary expansion means using an expression $P_{int,opt}=K_{int,opt}*GMP=K_{int,opt}*(P_{suc}*P_{dis})^{0,5}$, wherein, $P_{int,opt}$: Optimum intermediate pressure; $K_{int,opt}$: Optimum intermediate pressure coefficient; GMP: Geometric mean of the pressure of the high pressure side and the pressure of the low pressure side; $P_{suc}$: Pressure of the suction side of the compression element; and $P_{dis}$: Pressure of the discharge side of the compression element.

In a further aspect, a refrigerating apparatus includes a compression element, radiator, auxiliary expansion means, intermediate heat exchanger, main expansion means and evaporator constitute a refrigeration cycle, refrigerant flowing out of said radiator is branched into two streams. The first refrigerant stream is passed to the first flow path of the intermediate heat exchanger via said auxiliary expansion means, the second refrigerant stream is passed to the second flow path of the intermediate heat exchanger and then to the evaporator via said main expansion means. Heat exchange is performed between the two refrigerant stream within said intermediate heat exchanger, the refrigerant flowing out of said evaporator is sucked by low pressure part of said compression element, and the refrigerant flowing out of said intermediate heat exchanger is sucked by intermediate pressure part of said compression element. The pressure in said intermediate pressure part of the compression element being set to an optimum intermediate pressure calculated using an expression $P_{int,opt}=K_{int,opt}*GMP=K_{int,opt}*(P_{suc}*P_{dis})^{0,5}$, wherein, $P_{int,opt}$: Optimum intermediate pressure; $K_{int,opt}$: Optimum intermediate pressure coefficient; GMP: Geometric mean of the pressure of the high pressure side and the pressure of the low pressure side; $P_{suc}$: Pressure of the suction side of the compression element; and $P_{dis}$: Pressure of the discharge side of the compression element.

In another aspect, a refrigerating apparatus includes a compression element, radiator, auxiliary expansion means, intermediate heat exchanger, main expansion means and evaporator constitute a refrigeration cycle, refrigerant flowing out of said radiator is branched into two streams. The first refrigerant stream is passed to the first flow path of the intermediate heat exchanger via said auxiliary expansion means, the second refrigerant stream is passed to the second flow path of the intermediate heat exchanger and then to the evaporator via said main expansion means. Heat exchange is performed between the two refrigerant stream within said intermediate heat exchanger, the refrigerant flowing out of said evaporator is sucked by low pressure part of said compression element, and the refrigerant flowing out of said intermediate heat exchanger is sucked by intermediate pressure part of said compression element. The pressure in said intermediate pressure part of said compression element is determined by controlling said auxiliary expansion means in accordance with the ambient temperature and evaporator temperature.

In a further aspect, a refrigerating apparatus includes a compression element, radiator, auxiliary expansion means, intermediate heat exchanger, main expansion means and evaporator constitute a refrigeration cycle, refrigerant flowing out of said radiator is branched, into two streams. The first refrigerant stream is passed to the first flow path of the intermediate heat exchanger via said auxiliary expression means, the second refrigerant stream is passed to the second flow path of the intermediate heat exchanger and then to the evaporator via said main expansion means. Heat exchange is performed between the two refrigerant stream within said intermediate heat exchanger, the refrigerant flowing out of said evaporator is sucked by low pressure part of said compression element, and the refrigerant flowing out of said intermediate heat exchanger is sucked by intermediate pressure part of said compression element. The intermediate pressure in the intermediate pressure part of the compression element is controlled to an optimum intermediate pressure by controlling said auxiliary expansion means using an expression z=a+bx+cy+dx2+ey2+fxy, wherein, z: The aimed optimum intermediate pressure; x: Ambient temperature; y: Evaporator temperature; a: coefficient; b: coefficient; c: coefficient; d: coefficient; e: coefficient; and f: coefficient.

Further features of the invention, its nature and various advantages will be more apparent from the accompanying drawings and the following detailed description.

BRIEF DESCRIPTION OF THE DRAWINGS

The accompanying drawings illustrate several embodiments of the invention and, together with the description, serve to explain the principles of the invention.

DETAILED DESCRIPTION OF THE EMBODIMENTS

The present invention is now described more fully with reference to the accompanying figures, in which several embodiments of the invention are shown. The present invention may be embodied in many different forms and should not be construed as limited to the embodiments set forth herein. Rather these embodiments are provided so that this disclosure will be thorough and complete and will fully convey the invention to those skilled in the art.

A. Split Cycle System

Figure 1:
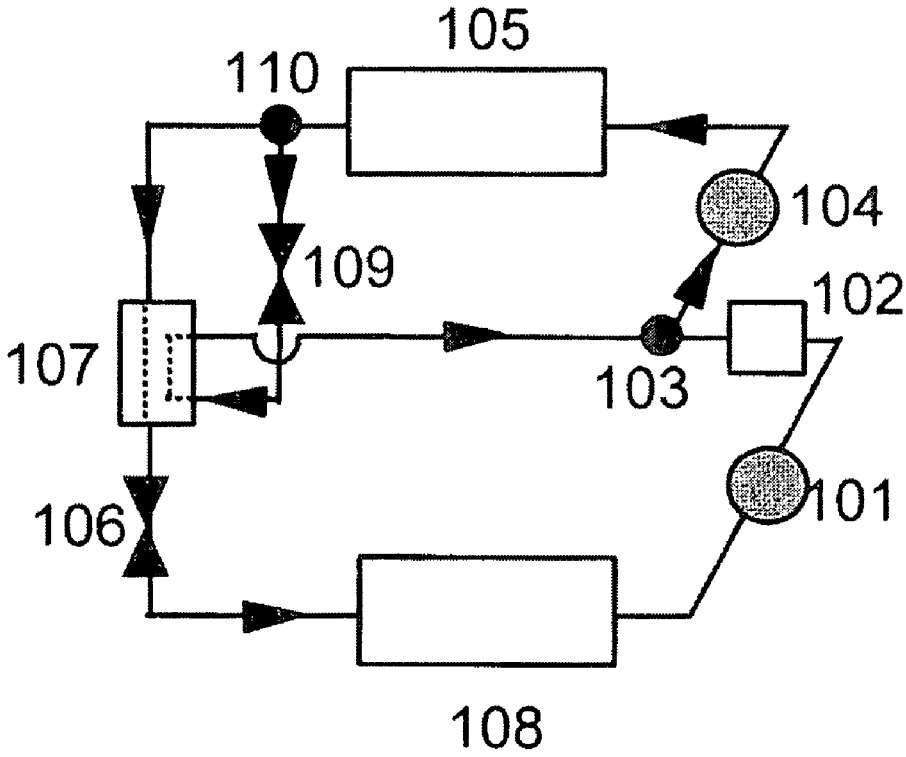
FIG. 1 is a block diagram illustrating a two stage refrigeration cycle according to an embodiment of the present invention.

FIG. 1 is a block diagram illustrating a two stage refrigeration cycle according to an embodiment of the present invention. The split cycle includes a low stage compression element 101, an intercooler 102, a mixing device for two fluid streams 103, a high stage compression element 104, a gas cooler heat exchanger 105 that cools the fluid stream leaving the high stage compression element by rejecting heat to a second fluid such as air or water, a main expansion valve 106, an intermediate heat exchanger 107, an evaporator 108 that evaporates the fluid stream in evaporator in heat exchange with a third fluid such as air or water. The outlet of the evaporator is connected to the low stage compression element suction port. There is further an auxiliary expansion valve 109 that connects the outlet of the gas cooler via the stream splitter 110 to the second path of the intermediate heat exchanger and the outlet of that path to the mixing device 103.

In certain embodiments, the system illustrated in FIG. 1 includes the following features:

1. The compression elements may be two separate compressors with separate motors, or may be combined into one unit with one motor or may be achieved by having one compression element with an intermediate suction port (and in that case no intercooler 102). In the case of a single compression element, the compressor has an intermediate suction port (intermediate pressure part) between the suction port (low pressure port) and the discharge port, and the refrigerant flowing out of the intermediate heat exchanger is sucked by the intermediate suction port. The preferred embodiment has two separate compression elements with an intercooler.
2. The intercooler may or may not be present. The preferred embodiment uses the intercooler.
3. The intermediate heat exchanger 107 may be arranged in a counter flow fashion or a parallel flow fashion or a mixed counter flow/parallel flow fashion. The preferred embodiment uses counter flow.

The expansion valves are controlled as described below and can be two separate valves or be incorporated into one valve body. The control concepts apply independent of the application of the refrigeration system (e.g., water heating, air-conditioning, heat pumping and refrigeration application) over the entire range of evaporator temperature levels.

B. Compressor Volume Ratio

The ratio of the displacement volume of the high side compressor over that of the low side compressor is dependent on the relative mass flow rates and densities at the respective compressor suction ports. The preferred volume ratio is in the range of 0.3 to 1.0. In an another exemplary embodiment, the volume ratio is in the range of 0.5 to 0.8.

Figure 2:
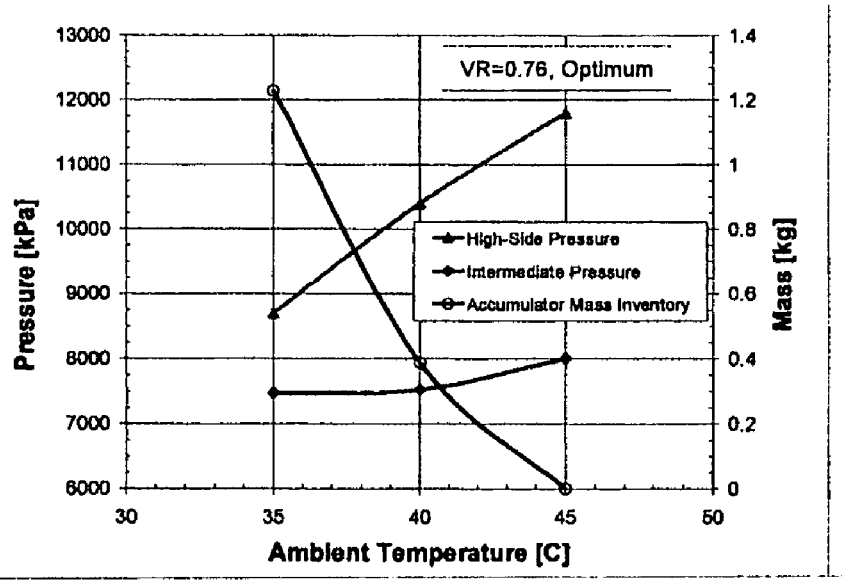
FIG. 2 is a graph illustrating optimized control characteristics for the split cycle according to an embodiment of the present invention.

System simulation has shown that the optimum displacement ratio is constant over a wide range of air-conditioning operating conditions. At equal speed of both compressor stages the optimum volume ratio of the stages is 0.76 for the component specifications assumed in the simulation. FIG. 2 shows the change of the remaining control variables at optimized operating conditions for a range of ambient temperatures.

Figure 3:
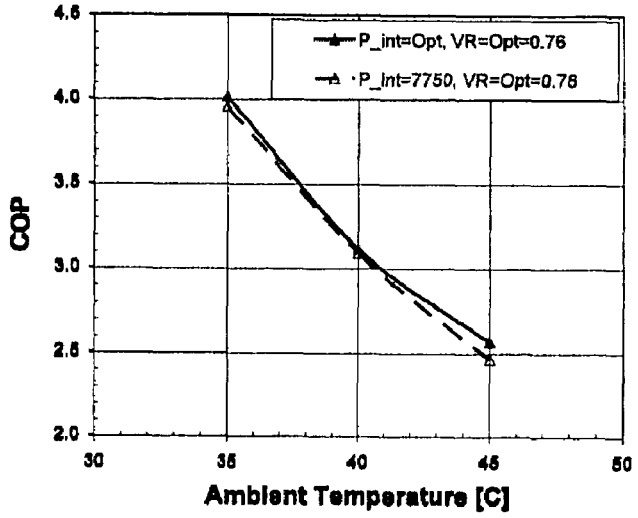
FIG. 3 is a graph illustrating split cycle with variable and constant intermediate pressure according to an embodiment of the present invention.
Figure 4:
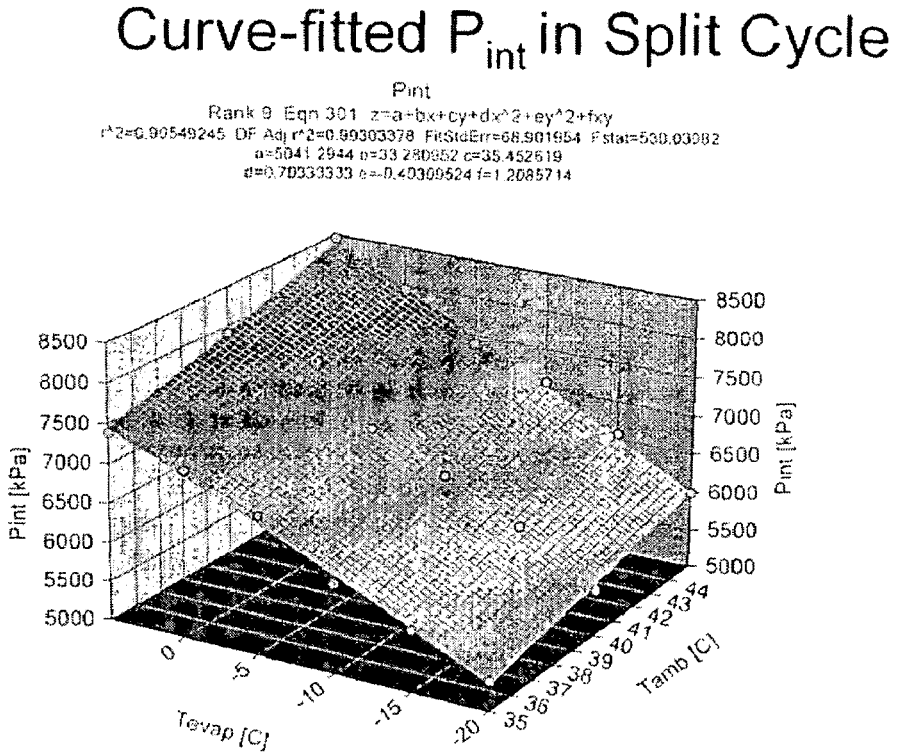
FIG. 4 is a graph illustrating a curve fit of the optimum intermediate pressure according to an embodiment of the present invention.

While simulation results show that the maximum coefficient of performance (COP) for the Split cycle is reached when the intermediate pressure is adjusted with ambient conditions, the system can be operated close to optimum conditions when the intermediate pressure is constant at an appropriate value. The difference in performance is illustrated in FIG. 3. FIG. 4 shows a curve fit of the optimum intermediate pressure as a function of evaporator and ambient temperatures.

C. Control Options

The mass flow rate through the intermediate heat exchanger 107 is controlled in one of the following ways:

1. First Option

The auxiliary expansion valve 109 is adjusted such that the intermediate pressure is maintained at a constant value within +/−50% of the value described by the equation shown in FIG. 4. In the preferred embodiment, the intermediate pressure may have a value of +/−20% of the one specified in the above equation. It should be noted that the preferred value will depend on the actual design of the system and is a function of other variables such as displacement volume ratio. The above equation serves as an example and covers the entire range of operating conditions.

The relationship between the operating pressures is expressed as follows: Control the high-side pressure while using the second order linear 6 coefficients equation below, which is a result of curve fitting of high-side pressure. This correlation has a confidence level of 98.9.

$$P_{dis}=a+b\,T_{amb}+c\,T_{evap}+dT_{amb}^2+e\,T_{evap}^2+f\,T_{amb}\,T_{evap} \quad (1)$$

Where a: −1854.91508 b: 334.4838095 c: −98.3269048 d:−0.60666667 E: 0.932619048 f: 3.522285714

Then determined the intermediate pressure from Equation 2 with constant value of optimum intermediate pressure coefficient (1.26) such as:

$$P_{int,opt}=K_{INT.OPT}*GMP=1.26*(P_{suc}*P_{dis})^{0.5} \quad (2)$$

The optimum intermediate pressure coefficient is given as 1.26 as the preferred value. Depending on operating conditions and system design, such as compressor displacement volume ratio, the value may vary from 1.1 to 1.6.

2. Second Option

The auxiliary expansion valve 109 is a thermostatic expansion valve for the following reason: In the conventional single-stage cycle the refrigerant entering the evaporator has been cooled from the high temperature of the gas cater outlet to the evaporator temperature by evaporating a portion of that refrigerant stream itself. Thus the entering vapor quality is quite high. The portion of refrigerant that was evaporated just of cool itself down is no compressed from the evaporator pressure level all the way to the high side pressure level. However, in the two-stage split cycle, the intermediate heat exchanger 107 has the purpose of precooling the main stream with the aid of the auxiliary stream. The inherent advantage is that the auxiliary stream cools the main stream by providing this cooling at a pressure level that is much higher than the evaporator pressure level and the resulting compressor work for this portion of the overall refrigerant flowrate is reduced considerably, leading to net savings. Thus, the more heat the auxiliary stream removes from the main stream, the better its effectiveness. Since the effectiveness of the auxiliary stream in precooling the main stream depends on the performance of the intermediate heat exchanger 107, the following control options are described. The auxiliary expansion valve 109 is a thermostatic expansion valve that adjusts the intermediate now rate such that one or more of the following temperatures are maintained constant as described below:

A. The intermediate heat exchanger 107 is a counter flow heat exchanger:

1. The temperature of the auxiliary stream leaving the intermediate heat exchanger 107 is within a certain range of the temperature of the incoming main stream. The actual value depends on whether or not the intermediate heat exchanger 107 is a counter flow heat exchanger and on its size relative to the other system components and the operating conditions of the system. In a preferred embodiment, the temperature is controlled within 5K of the incoming stream. In a second preferred embodiment, the temperature is controlled within 2K of the incoming stream.
2. The temperature of the main stream leaving the intermediate heat exchanger 107 is controlled within a certain range of the temperature of the incoming auxiliary stream. The actual value depends on whether or not the intermediate heat exchanger 107 is a counter flow heat exchanger and on its size relative to the other system components and the operating conditions of the system. In a preferred embodiment, the temperature is controlled within 5K of the incoming stream. In a second preferred embodiment, the temperature is controlled within 2K of the incoming stream.
3. The temperature of the auxiliary stream leaving the intermediate heat exchanger 107 is controlled within a certain range of the temperature of the incoming secondary stream to the gas cooler. The actual value depends on whether or not the intermediate heat exchanger 107 is a counter flow heat exchanger and on its size relative to the other system components and the operating conditions of the system. In a preferred embodiment, the temperature is controlled within 8K of the incoming stream. In a second preferred embodiment, the temperature is controlled within 4K of the incoming stream.
4. The temperature difference between the auxiliary stream leaving the intermediate heat exchanger 107 and the main stream entering that heat exchanger is controlled within a certain predetermined range. The actual value depends on whether or not the intermediate heat exchanger 107 is a counter flow heat exchanger and on its size relative to the other system components and the operating conditions of the system. In a preferred embodiment, the temperature is controlled within 5K of the incoming stream. In a second preferred embodiment, the temperature is controlled within 2K of the incoming stream.
5. The temperature difference between the auxiliary stream entering the intermediate heat exchanger 107 and the main stream leaving that heat exchanger is within a certain predetermined range. The actual value depends on whether or not the intermediate heat exchanger 107 is a counter flow heat exchanger and on its size relative to the other system components and the operating conditions of the system. In a preferred embodiment, the temperature is controlled within 5K of the incoming stream. In a second preferred embodiment, the temperature is controlled within 2K of the incoming stream.

B. The intermediate heat exchanger 107 is a parallel flow heat exchanger:

1. The temperature of the auxiliary stream leaving the intermediate heat exchanger 107 is controlled within a certain range of the temperature of the incoming main stream. The actual value depends on whether or not the intermediate heat exchanger 107 is a counter flow heat exchanger and on its size relative to the other system components and the operating conditions of the system. In a preferred embodiment, the temperature is controlled within 12K of the incoming stream. In a second preferred embodiment, the temperature is controlled within 6K of the incoming stream.
2. The temperature of the main stream leaving the intermediate heat exchanger 107 is controlled within a certain range of the temperature of the incoming auxiliary stream. The actual value depends on whether or not the intermediate heat exchanger 107 is a counter flow heat exchanger and on its size relative to the other system components and the operating conditions of the system. In a preferred embodiment, the temperature is controlled within 12K of the incoming stream. In a second preferred embodiment, the temperature is controlled within 6K of the incoming stream.

3. The temperature of the auxiliary stream leaving the intermediate heat exchanger 107 is controlled within a certain range of the temperature of the incoming secondary stream to the gas cooler. The actual value depends on whether or not the intermediate heat exchanger 107 is a counter flow heat exchanger and on its size relative to the other system components and the operating conditions of the system. In a preferred embodiment, the temperature is controlled within 15K of the incoming stream. In a second preferred embodiment, the temperature is controlled within 8K of the incoming stream.

4. The temperature difference between the auxiliary stream leaving the intermediate heat exchanger 107 and the main stream leaving that heat exchanger is controlled within a certain predetermined range. The actual value depends on whether or not the intermediate heat exchanger 107 is a counter flow heat exchanger and on its size relative to the other system components and the operating conditions of the system. In a preferred embodiment, the temperature is controlled within 10K of the incoming stream. In a second preferred embodiment, the temperature is controlled within 5K of the incoming stream. In a third preferred embodiment, the temperature difference is controlled within 2K or less.

3. Third Option

Constant Orifice Expansion Device for Auxiliary Stream: As one skilled in the art will appreciate, the description above is based on the assumption that the split cycle can be controlled at or close to optimum COP with only 2 active control devices. To investigate the feasibility of replacing the expansion valve by a constant orifice device, the following tasks were conducted. It should be noted that the following analysis has been conducted for a commercially available compressor manufactured by SANYO Electric Co., Ltd. (Osaka, Japan) having a displacement volume ratio 0.576.

a) Area of Constant Orifice Device

Area of the constant orifice device was calculated by using Equation 3 for a control valve (ASHRAE Handbook, Fundamentals, 1997, p. 2.11).

$$m = C_d A_o C_1 \left( \frac{P_{in}}{\sqrt{T_{in}}} \right) \sqrt{1 - \left( \frac{P_{out}}{P_{in}} \right)^{(k-1)/k}} \tag{3}$$

Where

-continued

| | |
|---|---|
| $Cd = 0.8$ | {discharge coefficient for chamfered orifice} |
| $Ao = pi/4 * Do\hat{}2$ | {orifice area} |
| $k = CP1/CVI$ | {ratio of specific heats} |
| $R = 8314.41/44\{J/kg - K\}$ | {Gas constant} |
| $C1 = ((2*k)/(R*(k-1)))\hat{}0.5$ | {constant} |

Figure 5:
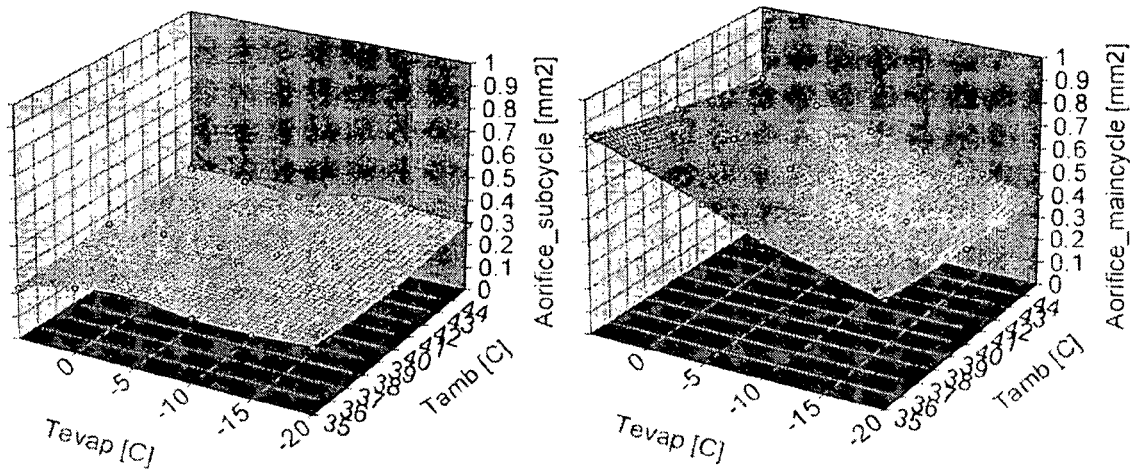
FIG. 5 is a graph illustrating valve orifice area according to an embodiment of the present invention.

By using properties of each state point and mass flow rate calculated from the above description, the orifice area is calculated for both sub- and main-cycle at various operating conditions. As shown in Table 1 below, the sub-cycle shows similar orifice area for various conditions: standard deviation is 7.9% of the average value. While the main-cycle shows the orifice area varying over a wide range: standard deviation is 22.6% of the average value. These behaviors are also shown in FIG. 5, which indicates that the valve area of the main-cycle decreases linearly with increasing ambient temperature and increasing evaporating temperature, and the valve area of the sub-cycle is approximately constant. The observation shows that it is possible to use a capillary tube or short tube for the sub-cycle expansion device.

TABLE 1

| | | Orifice Area | |
|---|---|---|---|
| Tamb[C.] | Tevap [C.] | $A_{orifice\ subc}$ [mm$^2$] | $A_{orifice\ mainc}$ [mm$^2$] |
| 35 | −20 | 0.287 | 0.456 |
| 40 | −20 | 0.267 | 0.413 |
| 45 | −20 | 0.292 | 0.390 |
| 35 | −15 | 0.273 | 0.512 |
| 40 | −15 | 0.297 | 0.474 |
| 45 | −15 | 0.311 | 0.442 |
| 35 | −10 | 0.278 | 0.579 |
| 40 | −10 | 0.290 | 0.531 |
| 45 | −10 | 0.309 | 0.493 |
| 35 | −5 | 0.302 | 0.673 |
| 40 | −5 | 0.270 | 0.591 |
| 45 | −5 | 0.256 | 0.528 |
| 35 | 0 | 0.284 | 0.766 |
| 40 | 0 | 0.266 | 0.668 |
| 45 | 0 | 0.270 | 0.599 |
| 35 | 5 | 0.223 | 0.849 |
| 40 | 5 | 0.256 | 0.747 |
| 45 | 5 | 0.276 | 0.672 |
| Average | [mm$^2$] | 0.278 | 0.577 |
| St. Dev | [%] | 7.9 | 22.6 |

b) COP Changes by Using Constant Orifice Device for the Sub-Cycle:

COP changes by using the constant orifice device for the sub-cycle were investigated. Results are summarized in the following Table. As shown in Table 2, the optimized COPs of the two cases are essentially the same.

TABLE 2

| | | Comparison of Two Control Schemes for Sub-Cycle | | | | | | |
|---|---|---|---|---|---|---|---|---|
| | | TXV Control | | | ST Control | | | COP |
| $T_{amb}$ [° C.] | $T_{evap}$ [° C.] | $P_{int}$ [kPa] | $P_{dis,\ 2nd}$ [kPa] | $COP_{opt,\ TXV}$ | $P_{int}$ [kPa] | $P_{dis,\ 2nd}$ [kPa] | $COP_{opt,\ TXV}$ | change [%] |
| 35 | −20 | 5391 | 8883 | 1.695 | 5362 | 8968 | 1.692 | −0.2 |
| 40 | −20 | 5708 | 10216 | 1.419 | 5778 | 9921 | 1.462 | 3.0 |
| 45 | −20 | 5990 | 11187 | 1.293 | 6195 | 10805 | 1.287 | −0.5 |
| 35 | −15 | 5797 | 8998 | 1.9 | 5834 | 8945 | 1.898 | −0.1 |
| 40 | −15 | 6195 | 10060 | 1.63 | 6230 | 9999 | 1.629 | −0.1 |

TABLE 2-continued

| | | Comparison of Two Control Schemes for Sub-Cycle | | | | | | |
|---|---|---|---|---|---|---|---|---|
| | | TXV Control | | | ST Control | | | COP |
| $T_{_amb}$ [° C.] | $T_{_evap}$ [° C.] | $P_{int}$ [kPa] | $P_{dis,\,2nd}$ [kPa] | $COP_{opt,\,TXV}$ | $P_{int}$ [kPa] | $P_{dis,\,2nd}$ [kPa] | $COP_{opt,\,TXV}$ | change [%] |
| 45 | −15 | 6580 | 11137 | 1.424 | 6615 | 11068 | 1.423 | −0.1 |
| 35 | −10 | 6146 | 9082 | 2.098 | 6235 | 9051 | 2.132 | 1.6 |
| 40 | −10 | 6646 | 10182 | 1.811 | 6638 | 10199 | 1.811 | 0.0 |
| 45 | −10 | 7075 | 11282 | 1.569 | 7050 | 11341 | 1.569 | 0.0 |
| 35 | −5 | 6760 | 8920 | 2.397 | 6623 | 9184 | 2.397 | 0.0 |
| 40 | −5 | 7050 | 10405 | 2.013 | 7053 | 10396 | 2.013 | 0.0 |
| 45 | −5 | 7388 | 12004 | 1.715 | 7496 | 11625 | 1.728 | 0.8 |
| 40 | 0 | 7497 | 10507 | 2.251 | 7469 | 10602 | 2.245 | −0.3 |
| 45 | 0 | 7941 | 12005 | 1.905 | 7952 | 11959 | 1.907 | 0.1 |
| 35 | 5 | 7388 | 9369 | 3.101 | 7379 | 9413 | 3.096 | −0.2 |

Thus, one skilled in the art will appreciate that an appropriately designed constant orifice expansion device can be applied for the auxiliary stream in a split cycle.

Figure 6:
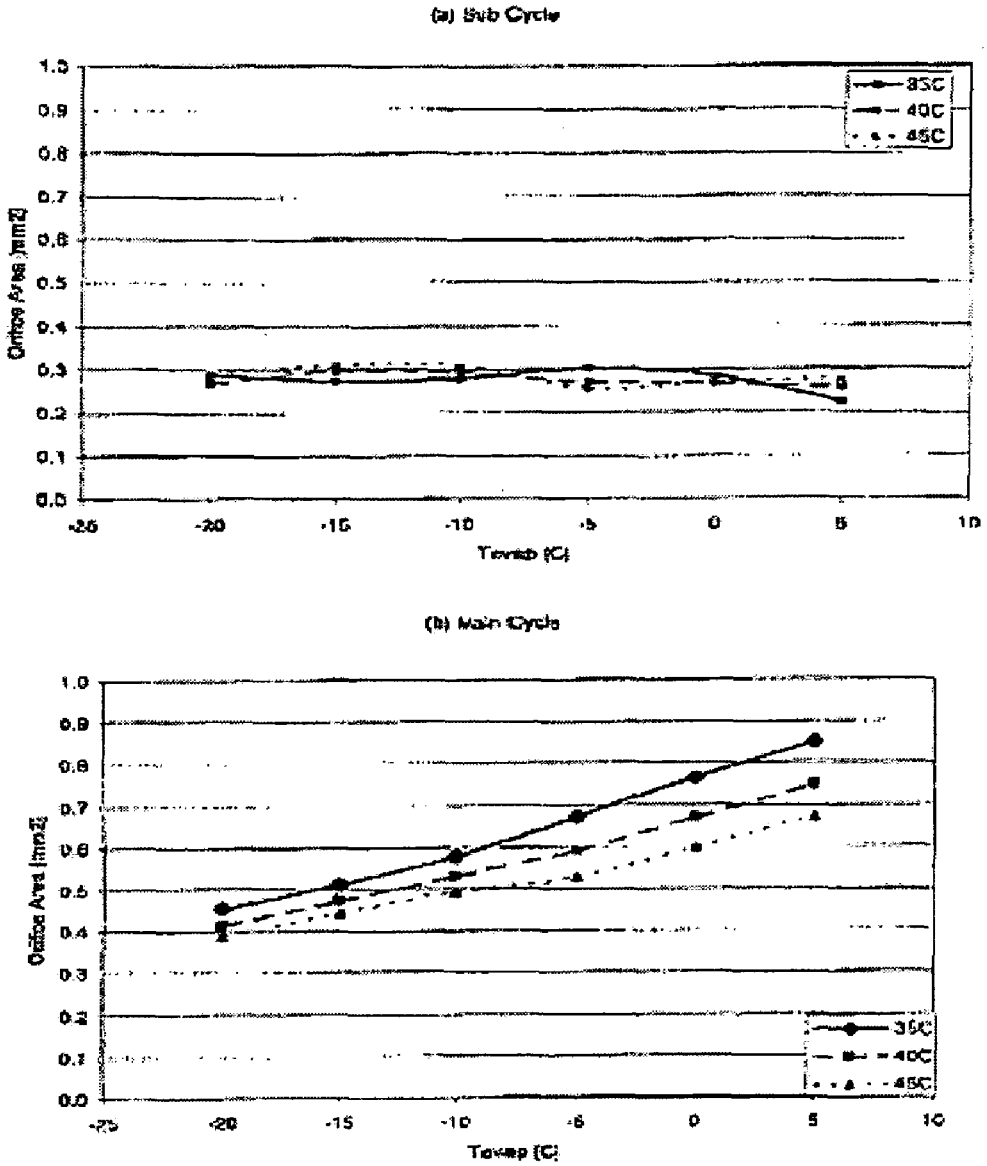
FIG. 6 is a graph illustrating the valve orifice area shown in FIG. 5 in two-dimensions.

FIG. 6 illustrates a two-dimensional figure of FIG. 5. Main cycle refers to the main expansion valve and the evaporator circuit, and sub cycle refers to the auxiliary expansion circuit.

Figure 7:
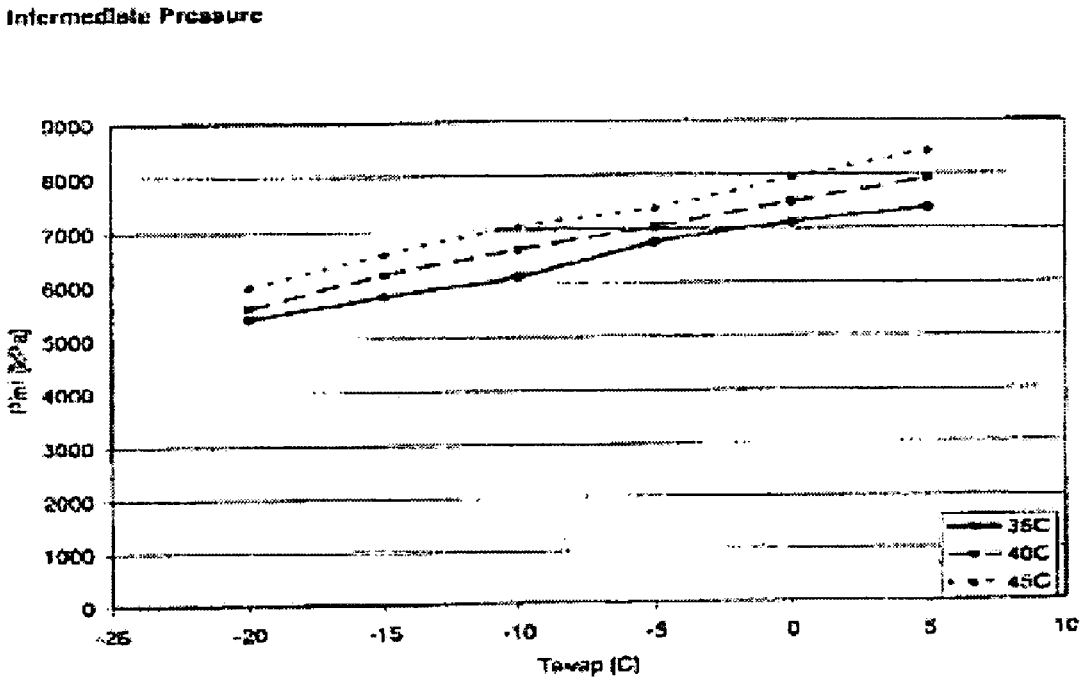
FIG. 7 is a graph illustrating optimum intermediate pressure Pint,opt according to an embodiment of the present invention.

FIG. 7 illustrates the Optimum intermediate pressure Pint, opt according to the temperature of the evaporator obtained by simulation.

Figure 8:
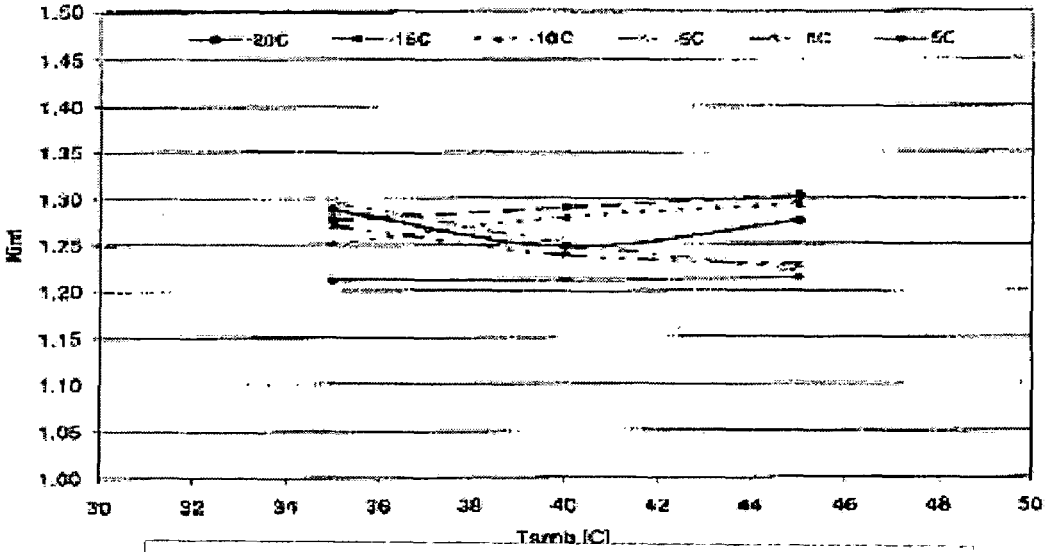
FIGS. 8 and 9 illustrate the range of the Optimum intermediate pressure coefficient Kint,opt.
Figure 9:
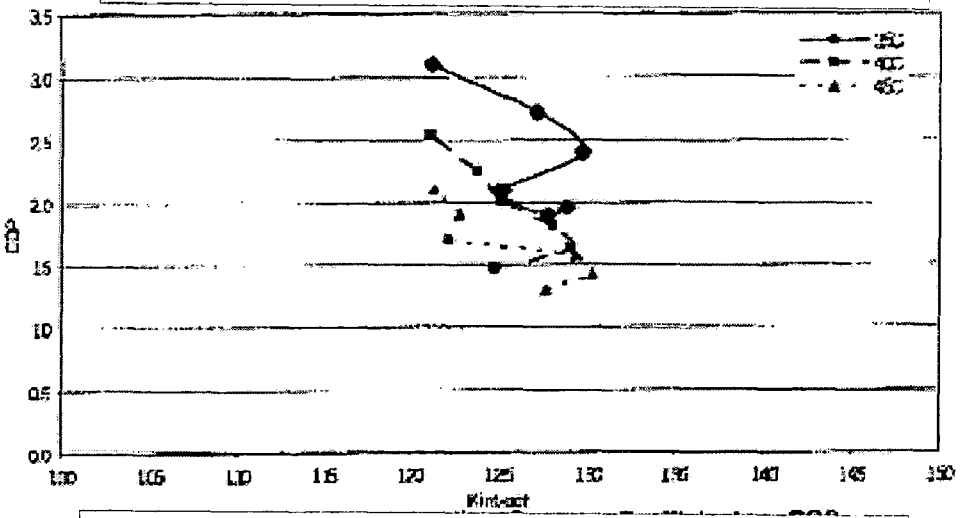

FIGS. 8 and 9 illustrate the range of the Optimum intermediate pressure coefficient Kint,opt. FIG. 8 shows the optimized intermediate pressure coefficient for various conditions. In the illustrated embodiment, the figure indicates that the optimized intermediate pressure coefficient ranges between 1.2 and 1.3. FIG. 9 shows the relationship between the optimized intermediate pressure coefficient and COP.

Figure 10:
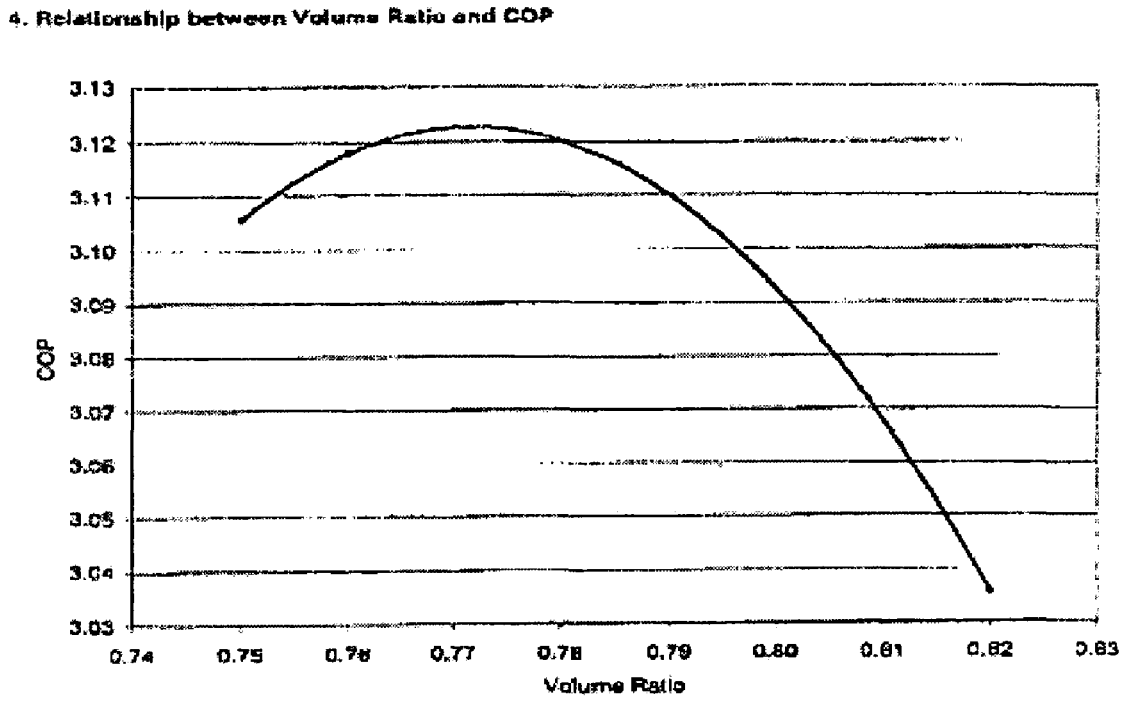
FIG. 10 illustrates the relationship between volume ratio and COP according to an embodiment of the present invention.

FIG. 10 illustrates the relationship of the ratio of the displacement volume of the high stage compression element 104 to the displacement volume of the low stage compression element 101 and the COP of the present refrigerating apparatus.

D. Expansion Valve Designs

Figure 11:
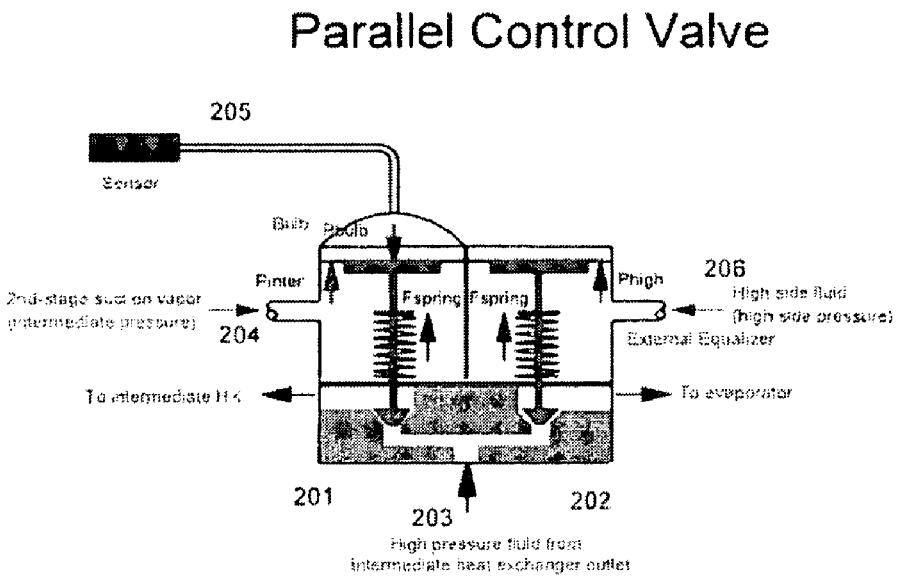
FIG. 11 illustrates a control value incorporating two expansion valves in one body according to one embodiment of the present invention.

Traditionally, two separate Parallel Control Valve expansion valves are used to control the two fluid streams. FIG. 11 illustrates a control value incorporating two expansion valves in one body according to one embodiment of the present invention. This implies that the auxiliary stream braches off after the intermediate heat exchanger 107. In FIG. 11, both the main and auxiliary streams share the same inlet stream 203, the high pressure fluid from the intermediate heat exchanger 107 outlet. The valve on the left 201 controls the intermediate mass flow rate using the intermediate pressure 204 or the temperature reading through the bulb 205 as input parameters as described above. The valve on the right 202 controls the high side pressure using its value at port 206 as input.

E. Other Cycle Configurations

Figure 12:
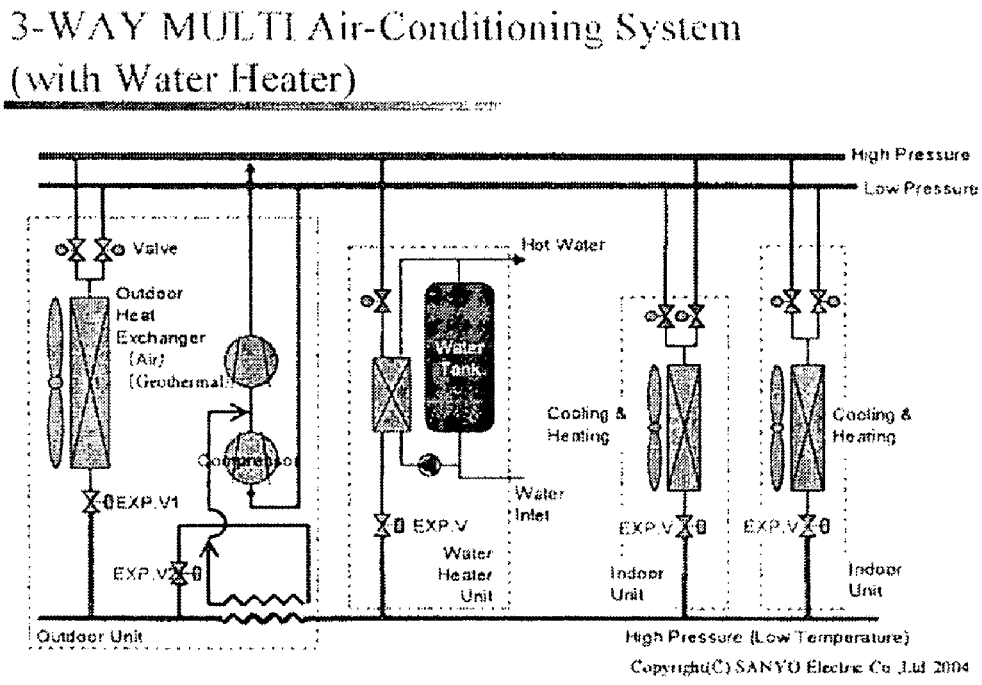
FIG. 12 is a block diagram illustrating a split cycle configuration with multiple evaporators according to an embodiment of the present invention.

The control concepts described herein are applicable independently of how many evaporator or gascoolers the cycle employs. FIG. 12 illustrates an example multiple evaporator system. The system can be used for air conditioning, heating and/or hot water preparation. It employs the split cycle design. For the portion of the split cycle, the same control considerations apply as described above with two added capabilities: (i) The expansion valve for the intermediate pressure EXP.V2 has a shut-off function built in for those cases where the intermediate flow rate is intended to be zero. (ii) Depending on the operating mode, the intermediate heat exchanger is operated in parallel or counter flow configuration. Thus the control mode and specifications of the valve EXP.V2 have to be adjusted according to the control algorithms specified above. In particular, the operating modes are as follows:

1. Air-conditioning mode: The intermediate heat exchanger 107 is operated in counter flow and the expansion valve EXP.V2 operated in counter flow mode.
2. Heating mode: The intermediate heat exchanger is operated in parallel mode and the expansion valve EXP.V2 is operated in parallel mode.
3. Water heating mode: The intermediate heat exchanger is not utilized and the expansion valve EXP.V2 is shut off.

Figure 13:
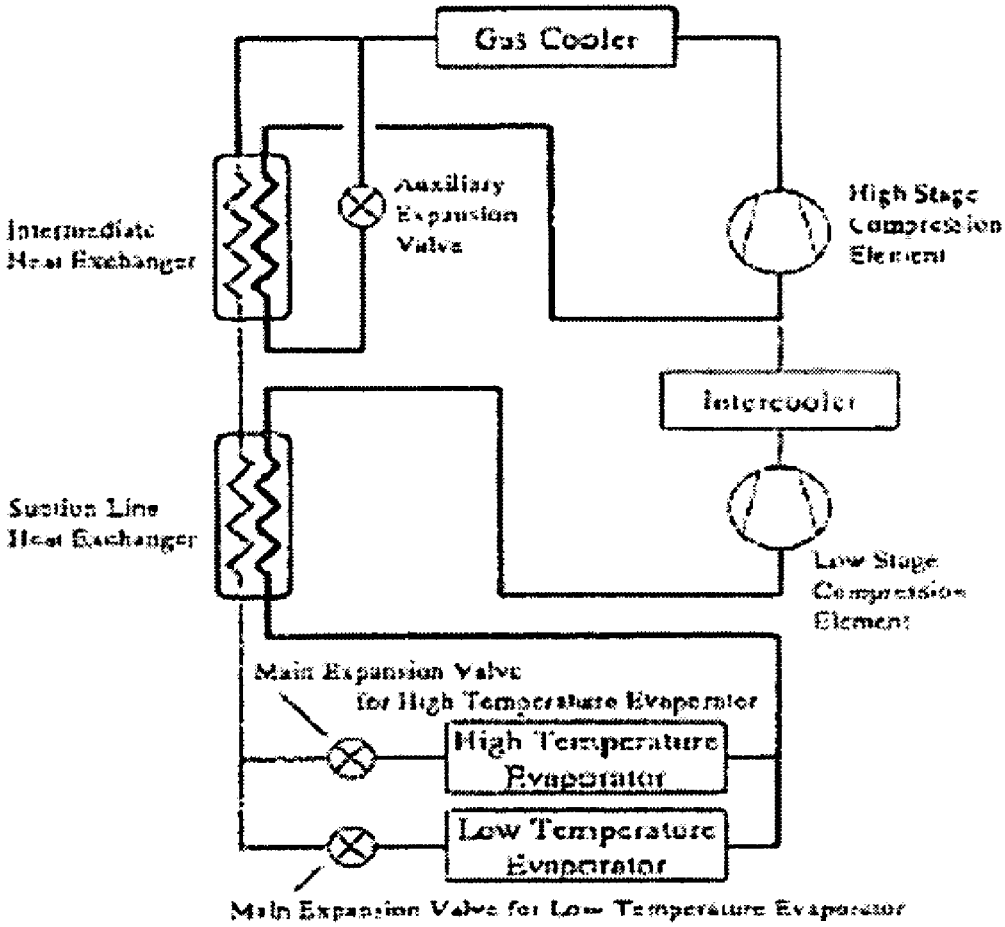
FIG. 13 is a block diagram illustrating a split cycle configuration according to another embodiment of the present invention.
Figure 14:
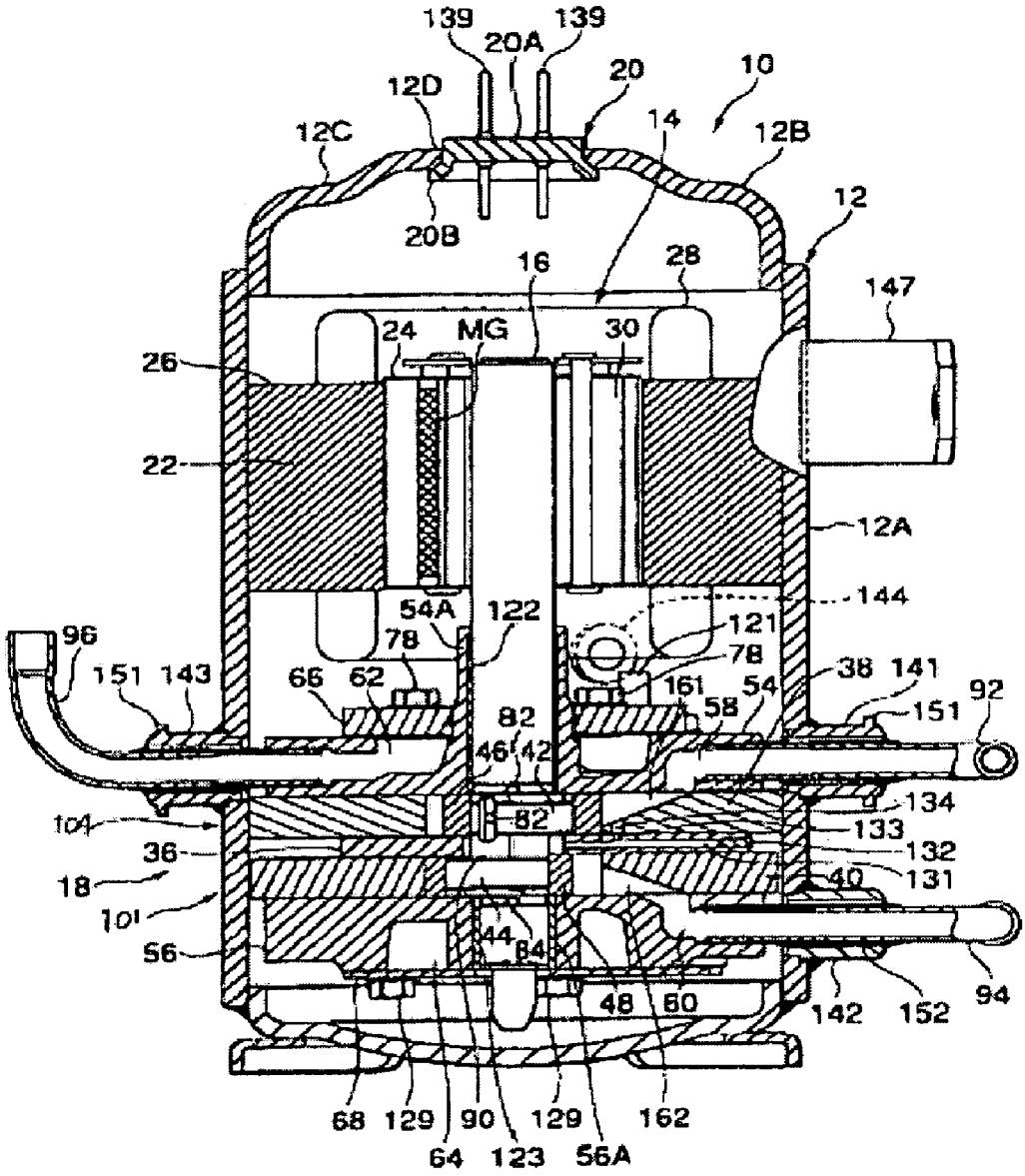
FIGS. 14-18 illustrate a multi-stage rotary compressor according to an embodiment of the present invention.
Figure 15:
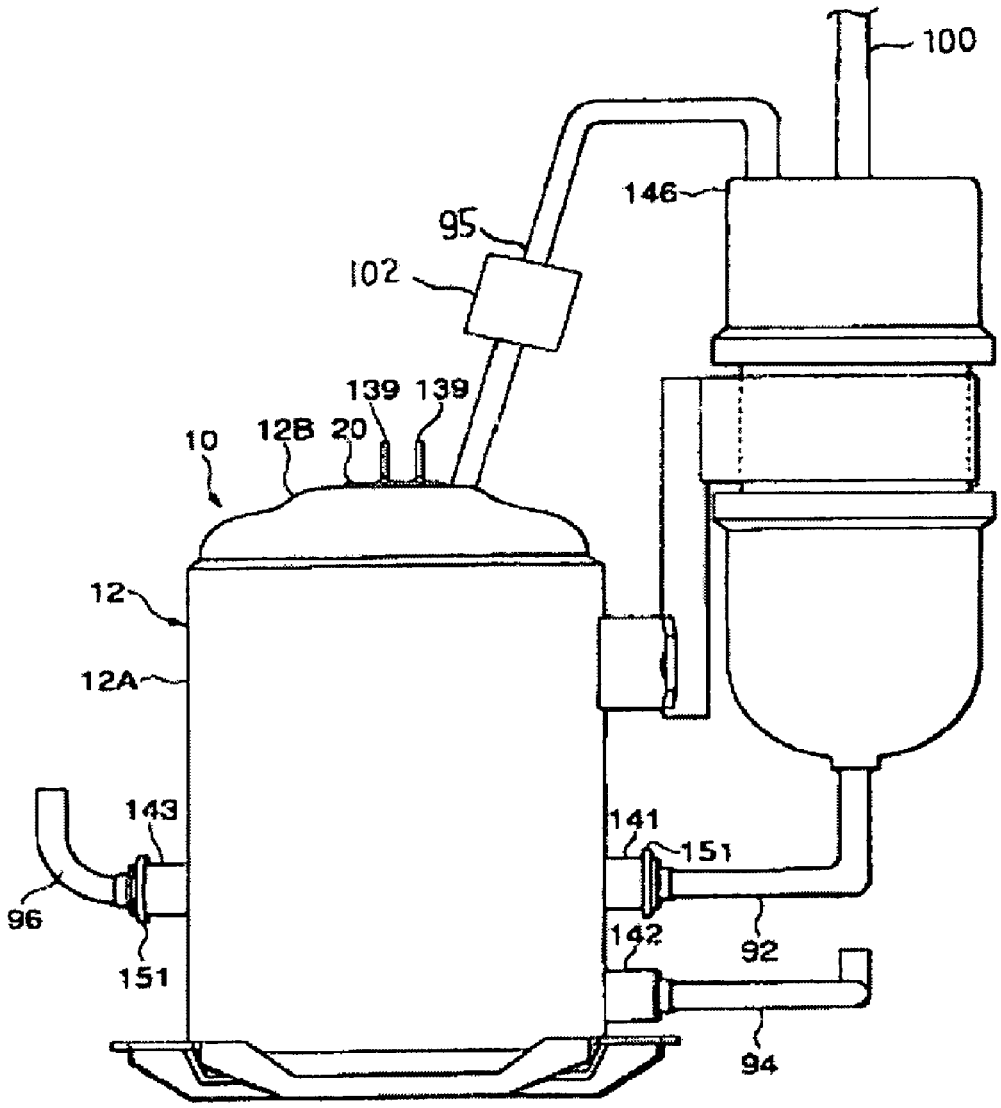
Figure 16:
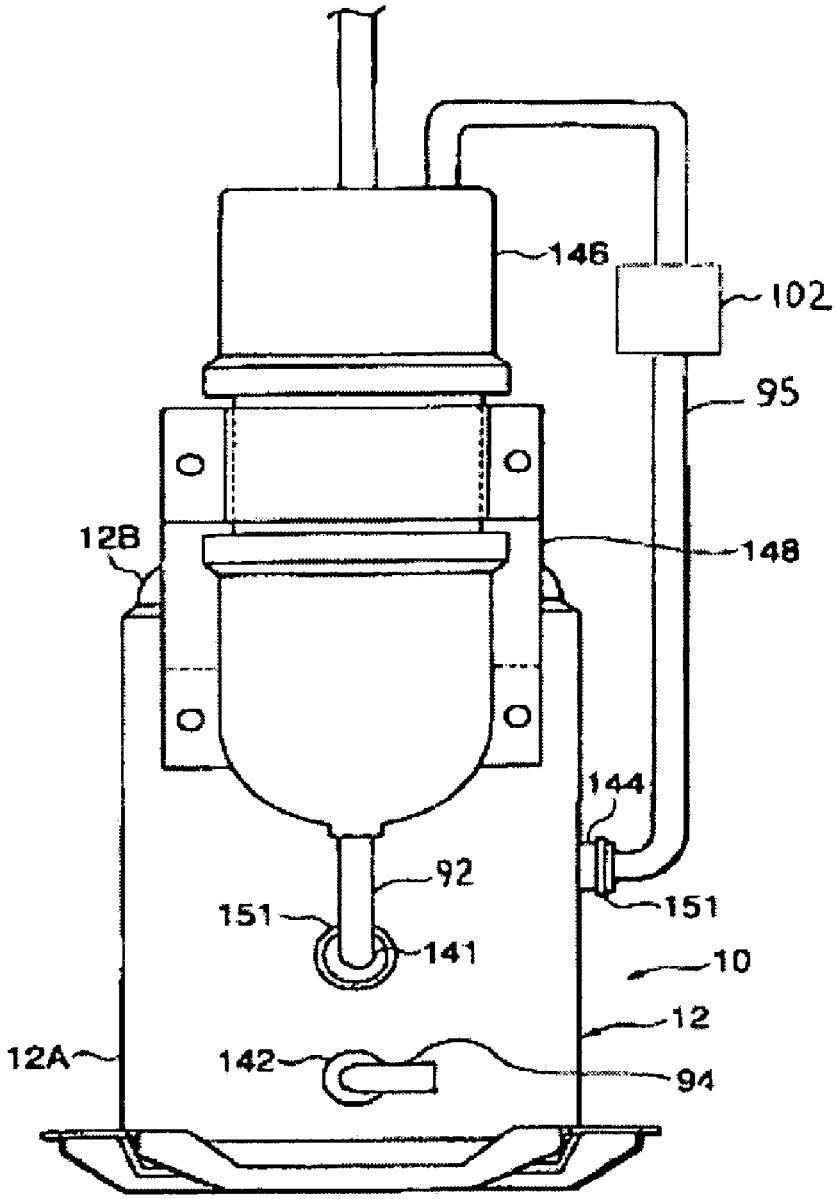

FIG. 13 illustrates a split cycle system having two evaporators, two main expansion devices and a suction line heat exchanger according to another embodiment of the present invention. This embodiment is suitable for a refrigeration system having two or more compartments which are maintained at different temperatures. For example, this system can be applied to a household refrigerator. Also, this exemplary embodiment can be used for commercial refrigeration systems (e.g., restaurants and stores).

One evaporator can be higher temperature, for example, suitable for fresh foods, and the other can be lower temperature suitable for frozen foods. The two main expansion devices have a shut-off function so that the refrigerant flows through the two evaporators alternately. When the main expansion valve for high temperature evaporator is closed, the refrigerant flows through the low temperature evaporator. On the contrary, when the main expansion valve for low temperature evaporator is closed, the refrigerant flows through the high temperature evaporator.

As one skilled in the art will appreciate, the control options described above are also applicable to this embodiment. The openings of the valves are determined by the same algorithm. Using a constant opening expansion device such as a capillary tube is especially suitable for domestic refrigerators because it is a simple method and low cost.

F. Compressor

1. Structure

FIGS. 14-18 illustrate a rotary compressor 10. The rotary compressor 10 is an internal intermediate pressure type multistage compression rotary compressor that uses carbon dioxide ($CO_2$) as its refrigerant. The rotary compressor 10 is constructed of a cylindrical hermetic vessel 12 made of a steel plate, an electromotive unit 14 disposed and accommodated at the upper side of the internal space of the hermetic vessel 12, and a rotary compression mechanism 18 that is disposed under the electromotive unit 14 and constituted by a low stage compression element 101 and a high stage compression element 104 that are driven by a rotary shaft 16 of the electromotive unit 14. The height of the rotary compressor 10 of the embodiment 220 mm (outside diameter being 120 mm), the height of the electromotive unit 14 is about 80 mm (the outside diameter thereof being 110 mm), and the height of the rotary compression mechanism 18 is about 70 mm (the outside diameter thereof being 110 mm). The gap between the electromotive unit 14 and the rotary compression mechanism 18 is about 5 mm. The excluded volume of the high stage compression element 104 is set to be smaller than the excluded volume of the low stage compression element 101.

The hermetic vessel 12 according to this embodiment is formed of a steel plate having a thickness of 4.5 mm, and has an oil reservoir at its bottom, a vessel main body 12A for housing the electromotive unit 14 and the rotary compression mechanism 18, and a substantially bowl-shaped end cap (cover) 12B for closing the upper opening of the vessel main body 12A. A round mounting hole 12D is formed at the center of the top surface of the end cap 12B, and a terminal (the wire being omitted) 20 for supply power to the electromotive unit 14 is installed to the mounting hole 12D.

In this case, the end cap 12B surrounding the terminal 20 is provided with an annular stepped portion 12C having a predetermined curvature that is formed by molding. The terminal 20 is constructed of a round glass portion 20A having electrical terminals 139 penetrating it, and a metallic mounting portion 20B formed around the glass portion 20A and extends like a jaw aslant downward and outward. The thickness of the mounting portion 20B is set to 2.4+0.5 mm. The terminal 20 is secured to the end cap 12B by inserting the glass portion 20A from below into the mounting hole 12D to jut it out to the upper side, and abutting the mounting portion 20B against the periphery of the mounting hole 12D, then welding the mounting portion 20B to the periphery of the mounting hole 12D of the end cap 12B.

The electromotive unit 14 is formed of a stator 22 annularly installed along the inner peripheral surface of the upper space of the hermetic vessel 12 and a rotor 24 inserted in the stator 22 with a slight gap provided therebetween. The rotor 24 is secured to the rotary shaft 16 that passes through the center thereof and extends in the perpendicular direction.

The stator 22 has a laminate 26 formed of stacked donut-shaped electromagnetic steel plates, and a stator coil 28 wound around the teeth of the laminate 26 by series winding or concentrated winding. As in the case of the stator 22, the rotor 24 is formed also of a laminate 30 made of electromagnetic steel plates, and a permanent magnet MG is inserted in the laminate 30.

An intermediate partitioner 36 is sandwiched between the low stage compression element 101 and the high stage compression element 104. More specifically, the low stage compression element 101 and the high stage compression element 104 are constructed of the intermediate partitioner 36, a cylinder 38 and a cylinder 40 disposed on and under the intermediate partitioner 36, upper and lower rollers 46 and 48 that eccentrically rotate in the upper and lower cylinders 38 and 40 with a 180-degree phase difference by being fitted to upper and lower eccentric portions 42 and 44 provided on the rotary shaft 16, upper and lower vanes 50 (the lower vane being not shown) that abut against the upper and lower rollers 46 and 48 to partition the interiors of the upper and lower cylinders 38 and 40 into low-pressure chambers and high-pressure chambers, as it will be discussed hereinafter, and an upper supporting member 54 and a lower supporting member 56 serving also as the bearings of the rotary shaft 16 by closing the upper open surface of the upper cylinder 38 and the bottom open surface of the lower cylinder 40.

The upper supporting member 54 and the lower supporting member 56 are provided with suction passages 58 and 60 in communication with the interiors of the upper and lower cylinders 38 and 40, respectively, through suction ports 161 and 162, and recessed discharge muffling chambers 62 and 64. The open portions of the two discharge muffling chambers 62 and 64 are closed by covers. More specifically, the discharge muffling chamber 62 is closed by an upper cover 66, and the discharge muffling chamber 64 is closed by a lower cover 68.

In this case, a bearing 54A is formed upright at the center of the upper supporting member 54, and a cylindrical bush 122 is installed to the inner surface of the bearing 54A. Furthermore, a bearing 56A is formed in a penetrating fashion at the center of the lower supporting member 56. A cylindrical bush 123 is attached to the inner surface of the bearing 56A also. These bushes 122 and 123 are made of a material exhibiting good slidability, as it will be discussed hereinafter, and the rotary shaft 16 is retained by a bearing 54A of the upper supporting member 54 and a bearing 56A of the lower supporting member 56 through the intermediary of the bushes 122 and 123.

In this case, the lower cover 68 is formed of a donut-shaped round steel plate, and secured to the lower supporting member 56 from below by main bolts 129 at four points on its peripheral portion. The lower cover 68 closes the bottom open portion of the discharge muffling chamber 64 in communication with the interior of the lower cylinder 40 of the low stage compression element 101 through a discharge port 41. The distal ends of the main bolts 129 are screwed to the upper supporting members 54. The inner periphery of the lower cover 68 projects inward beyond the inner surface of the bearing 56A of the lower supporting member 56 so as to retain the bottom end surface of the bush 123 by the lower cover 68 to prevent it from coming off.

The lower supporting member 56 is formed of a ferrous sintered material (or castings), and its surface (lower surface) to which the lower cover 68 is attached is machined to have a flatness of 0.1 mm or less, then subjected to steaming treatment. The steaming treatment causes the ferrous surface to which the lower cover 68 is attached to an iron oxide surface, so that the pores inside the sintered material are closed, leading to improved sealing performance. This obviates the need for providing a gasket between the lower cover 68 and the lower supporting member 56.

Figure 17:
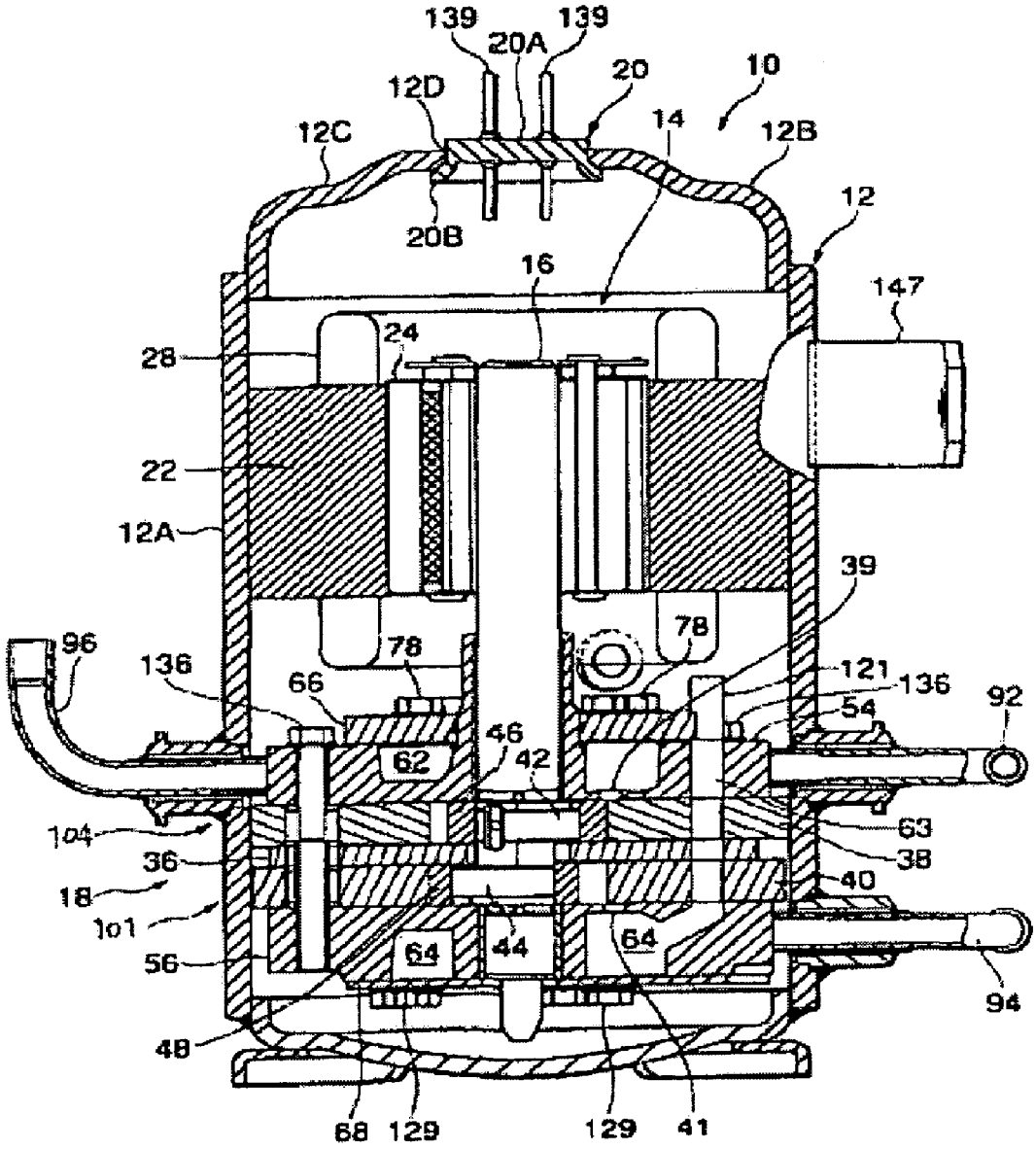
Figure 18:
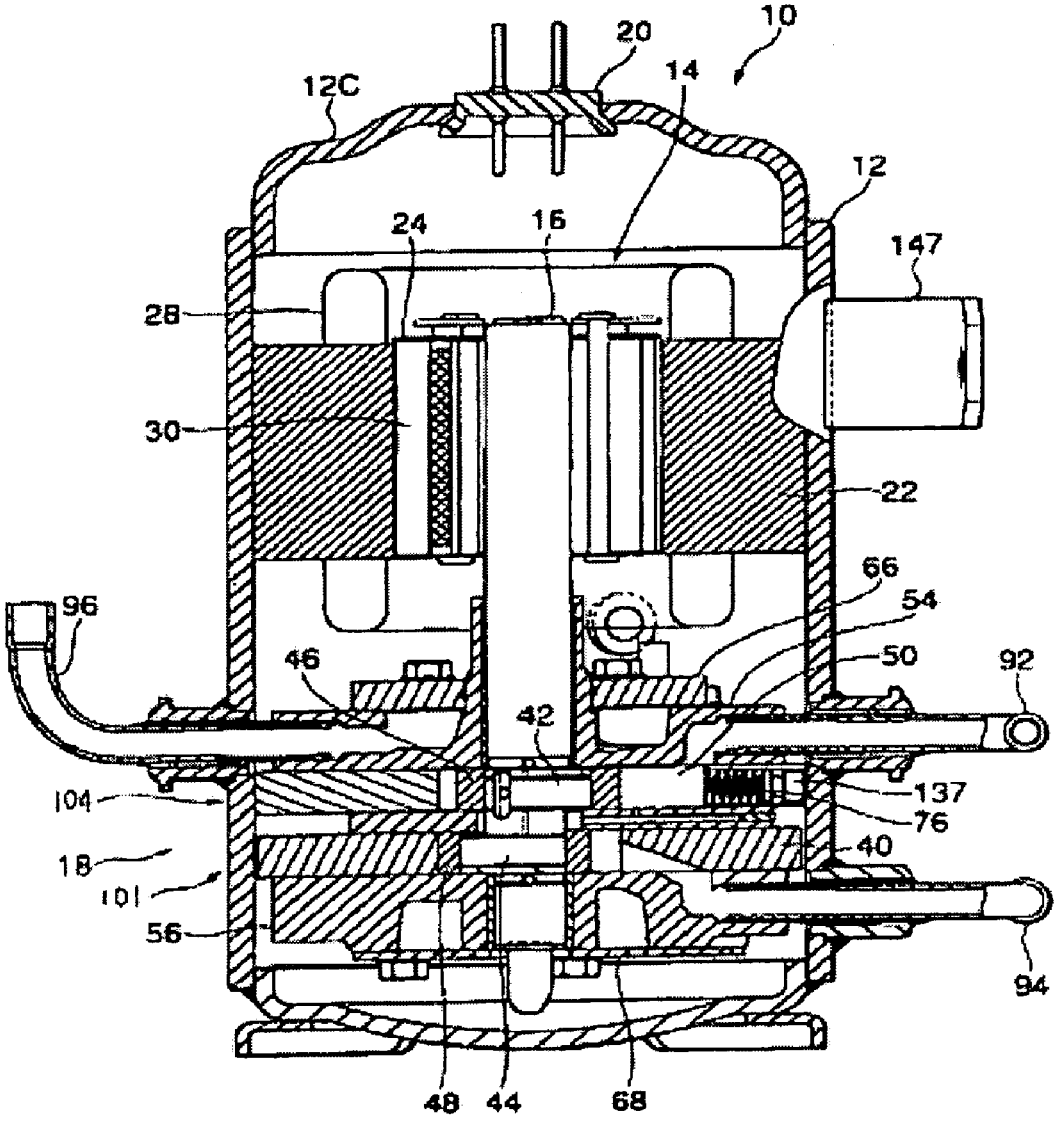

The discharge muffling chamber 64 and the upper cover 66 at the side adjacent to the electromotive unit 14 in the interior of the hermetic vessel 12 are in communication with each other through a communicating passage 63, which is a hole passing through the upper and lower cylinders 38 and 40 and the intermediate partitioner 36 (FIG. 17). In this case, an intermediate discharge pipe 121 is provided upright at the upper end of the communicating passage 63. The intermediate discharge pipe 121 is directed to the gap between adjoining stator coils 28 and 28 wound around the stator 22 of the electromotive unit 14 located above.

The upper cover 66 closes the upper surface opening of the discharge muffling chamber 62 in communication with the interior of the upper cylinder 38 of the high stage compression element 104 through a discharge port 39, and partitions the interior of the hermetic vessel 12 to the discharge muffling chamber 62 and a chamber adjacent to the electromotive unit 14. The upper cover 66 has a thickness of 2 mm or more and 10 mm or less (the thickness being set to the most preferable value, 6 mm, in this embodiment), and is formed of a substantially donut-shaped, circular steel plate having a hole through which the bearing 54A of the upper supporting member 54 penetrates. With a gasket 124 sandwiched between the upper cover 66 and the upper supporting member 54, the peripheral portion of the upper cover 66 is secured from above to the upper supporting member 54 by four main bolts 78 through the intermediary of the gasket 124. The distal ends of the main bolts 78 are screwed to the lower supporting member 56.

Setting the thickness of the upper cover 66 to such a dimensional range makes it possible to achieve a reduced size, durability that is sufficiently high to survive the pressure of the discharge muffling chamber 62 that becomes higher than that of the interior of the hermetic vessel 12, and a secured insulating distance from the electromotive unit 14.

The intermediate partitioner 36 that closes the lower open surface of the upper cylinder 38 and the upper open surface of the lower cylinder 40 has a through hole 131 that is located at the position corresponding to the suction side in the upper cylinder 38 and extends from the outer peripheral surface to the inner peripheral surface to establish communication between the outer peripheral surface and the inner peripheral surface thereby to constitute an oil feeding passage. A sealing member 132 is press-fitted to the outer peripheral surface of the through hole 131 to seal the opening in the outer peripheral surface. Furthermore, a communication hole 133 extending upward is formed in the middle of the through hole 131.

In addition, a communication hole 134 linked to the communication hole 133 of the intermediate partitioner 36 is opened in the suction port 161 (suction side) of the upper cylinder 38. The rotary shaft 16 has an oil hole oriented perpendicularly to the axial center and horizontal oil feeding holes 82 and 84 (being also formed in the upper and lower eccentric portions 42 and 44 of the rotary shaft 16) in communication with the oil hole. The opening at the inner peripheral surface side of the through hole 131 of the intermediate partitioner 36 is in communication with the oil hole through the intermediary of the oil feeding holes 82 and 84.

As it will be discussed hereinafter, the pressure inside the hermetic vessel 12 will be an intermediate pressure, so that it will be difficult to supply oil into the upper cylinder 38 that will have a high pressure due to the second stage. However, the construction of the intermediate partitioner 36 makes it possible to draw up the oil from the oil reservoir at the bottom in the hermetic vessel 12, lead it up through the oil hole to the oil feeding holes 82 and 84 into the through hole 131 of the intermediate petitioner 36, and supply the oil to the suction side of the upper cylinder 38 (the suction port 161) through the communication holes 133 and 134.

As described above, the upper and lower cylinders 38, 40, the intermediate partitioners 36, the upper and lower supporting members 54, 56, and the upper and lower covers 66, 68 are vertically fastened by four main bolts 78 and the main bolts 129. Furthermore, the upper and lower cylinders 38, 40, the intermediate partitioner 36, and the upper and lower supporting members 54, 56 are fastened by auxiliary bolts 136, 136 located outside the main bolts 78, 129 (FIG. 17). The auxiliary bolts 136 are inserted from the upper supporting member 54, and the distal ends thereof are screwed to the lower supporting member 56.

The auxiliary bolts 136 are positioned in the vicinity of a guide groove 70 (to be discussed later) of the foregoing vane 50. The addition of the auxiliary bolts 136, 136 to integrate the rotary compression mechanism 18 secures the sealing performance against an extremely high internal pressure. Moreover, the fastening is effected in the vicinity of the guide groove 70 of the vane 50, thus making it possible to also prevent the leakage of the high back pressure (the pressure in a back pressure chamber 201) applied to the vane 50, as it will be discussed hereinafter.

The upper cylinder 38 incorporates a guide groove 70 accommodating the vane 50, and an housing portion 70A for housing a spring 76 positioned outside the guide groove 70, the housing portion 70A being opened to the guide groove 70 and the hermetic vessel 12 or the vessel main body 12A. The spring 76 abuts against the outer end portion of the vane 50 to constantly urge the vane 50 toward the roller 46. A metallic plug 137 is press-fitted through the opening at the outer side (adjacent to the hermetic vessel 12) of the housing portion 70A into the housing portion 70A for the spring 76 at the end adjacent to the hermetic vessel 12. The plug 137 functions to prevent the spring 76 from coming off.

In this case, the outside diameter of the plug 137 is set to value that does not cause the upper cylinder 38 to deform when the plug 137 is press-fitted into the housing portion 70A, while the value is larger than the inside diameter of the housing portion 70A at the same time. More specifically, in the embodiment, the outside diameter of the plug 137 is designed to be larger than the inside diameter of the housing portion 70A by 4 μm to 23 μm. An O-ring 138 for sealing the gap between the plug 137 and the inner surface of the housing portion 70A is attached to the peripheral surface of the plug 137.

In this case, as the refrigerant, the foregoing carbon dioxide ($CO_2$), an example of carbonic acid gas, which is a natural refrigerant is used primarily because it is gentle to the earth and less flammable and toxic. For the oil functioning as a lubricant, an existing oil, such as mineral oil, alkylbenaene oil, ether oil, or ester oil is used.

On a side surface of the vessel main body 12A of the hermetic vessel 12, sleeves 141, 142, 143, and 144 are respectively fixed by welding at the positions corresponding to the positions of the suction passages 58 and 60 of the upper supporting member 54 and the lower supporting member 56, the discharge muffling chamber 62, and the upper side of the upper cover 66 (the position substantially corresponding to the bottom end of the electromotive unit 14). The sleeves 141 and 142 are vertically adjacent, and the sleeve 143 is located on a substantially diagonal line of the sleeve 141. The sleeve 144 is located at a position shifted substantially 90 degrees from the sleeve 141.

One end of a refrigerant introducing pipe 92 for leading a refrigerant gas into the upper cylinder 38 is inserted into the sleeve 141, and the one end of the refrigerant introducing pipe 92 is in communication with the suction passage 58 of the upper cylinder 38. The other end of the refrigerant introducing pipe 92 is connected to the bottom end of a flow combiner 146. The one end of the pipe 95 and 100 are connected to the upper end of the flow combiner 146. And the other end of the pipe 95 connected to the sleeve 144 via the intercooler 102 (FIG. 1) to be in communication with the interior of the hermetic vessel 12.

Furthermore, one end of a refrigerant introducing pipe 94 for leading a refrigerant gas into the lower cylinder 40 is inserted in and connected to the sleeve 142, and the one end of the refrigerant introducing pipe 94 is in communication with the suction passage 60 of the lower cylinder 40. The other end of the pipe 94 is connected to the evaporator 108 (FIG. 1). A refrigerant discharge pipe 96 is inserted in and connected to the sleeve 143, and one end of the refrigerant discharge pipe 96 is in communication with the discharge muffling chamber 62. The other end of the pipe 96 is connected to the gas cooler heat exchanger 105 (FIG. 1).

Furthermore, collars 151 with which couplers for pipe connection can be engaged are disposed around the outer surfaces of the sleeves 141, 143, and 144. The inner surface of the sleeve, 142 is provided with a thread groove 152 for pipe connection. This allows the couplers for test pipes to be easily connected to the collars 151 of the sleeves 141, 143, and 144 to carry out an airtightness test in the final inspection in the manufacturing process of the compressor 10. In addition, the thread groove 152 allows a test pipe to be easily screwed into the sleeve 142. Especially in the case of the vertically adjoining sleeves 141 and 142, the sleeve 141 has the collar 151, while the sleeve 142 has a thread groove 152, so that test pipes can be connected to the sleeves 141 and 142 in a small space.

2. Operation

The descriptions will now be given of the operation. A controller controls the number of revolutions of the electromotive unit 14 of the rotary compressor 10. The moment the stator coil 28 of the electromotive unit 14 is energized through the intermediary of the terminal 20 and a wire (not shown) by the controller, the electromotive unit 14 is started and the rotor 24 rotates. This causes the upper and lower rollers 46 and 48 fitted to the upper and lower eccentric portions 42 and 44 provided integrally with the rotary shaft 16 to eccentrically rotate in the upper and lower cylinders 38 and 40.

Thus, a low-pressure refrigerant gas (1st-stage suction pressure LP: 4 MPaG) that has been introduced into a low-pressure chamber of the lower cylinder 40 from a suction port 162 via the refrigerant introducing pipe 94 and the suction passage 60 formed in the lower supporting member 56 is compressed by the roller 48 and the vane in operation to obtain an intermediate pressure (MP1:8 MPaG). The refrigerant gas of the intermediate pressure leaves the high-pressure chamber of the lower cylinder 40, passes through the discharge port 41, the discharge muffling chamber 64 provided in the lower supporting member 56, and the communication passage 63, and is discharged into the hermetic vessel 12 from the intermediate discharge pipe 121.

At this time, the intermediate discharge pipe 121 is directed toward the gap between the adjoining stator coils 28 and 28 wound around the stator 22 of the electromotive unit 14 thereabove; hence, the refrigerant gas still having a relatively low temperature can be positively supplied toward the electromotive unit 14, thus restraining a temperature rise in the electromotive unit 14. At the same time, the pressure inside the hermetic vessel 12 reaches the intermediate pressure (MP1).

The intermediate-pressure refrigerant gas in the hermetic vessel 12 comes out of the sleeve 144 at the above intermediate pressure (MP1), passes through the pipe 95 and the intercooler 102 (FIG. 1), and is combined with the refrigerant from the intermediate heat exchanger 107 (FIG. 1) through the pipe 100.

The combined refrigerant in the flow combiner 146 flow out from the bottom end, passes through the pipe 92 and the suction passage 58 formed in the upper supporting member 54, and is drawn into the low-pressure chamber (2nd-stage suction pressure being MP2) of the upper cylinder 38 through a suction port 161. The intermediate-pressure refrigerant gas that has been drawn in is subjected to a second-stage compression by the roller 46 and the vane 50 in operation so as to be turned into a hot high-pressure refrigerant gas (2nd-stage discharge pressure HP: 12 MPaG). The hot high-pressure refrigerant gas leaves the high-pressure chamber, passes through the discharge port 39, the discharge muffling chamber 62 provided in the upper supporting member 54, and the refrigerant discharge pipe 96.

Having described embodiments of multi-stage refrigeration system including sub-cycle control characteristics (which are intended to be illustrative and not limiting), it is noted that modifications and variations can be made by persons skilled in the art in light of the above teachings. It is therefore to be understood that changes may be made in the particular embodiments of the invention disclosed that are within the scope and spirit of the invention as defined by the appended claims and equivalents.

What is claimed is:

1. A refrigerating apparatus comprising compression element having an intermediate and low pressure parts, radiator, auxiliary expansion means, intermediate heat exchanger, main expansion means and evaporator which constitute a refrigeration cycle, wherein refrigerant flowing out of said radiator is branched into two streams, in which (1) a first refrigerant stream passes through the first flow path of the intermediate heat exchanger via said auxiliary expansion means, (2) a second refrigerant stream passes through the second flow path of the intermediate heat exchanger, the main expansion means, the evaporator, and the low pressure part of the compression element, and merges with the first refrigerant stream, and (3) the merged stream flows into the intermediate pressure part of the compression element, heat exchange is performed between the two refrigerant stream within said intermediate heat exchanger, the refrigerant flowing out of said evaporator is sucked by the low pressure part of said compression element, the refrigerant flowing out of said intermediate heat exchanger is sucked by the intermediate pressure part of said compression element, wherein the temperature of said second refrigerant stream exiting the intermediate heat exchanger or the temperature of said first refrigerant stream exiting the intermediate heat exchanger is controlled to a predetermined value by adjusting the amount of said first refrigerant stream by controlling said auxiliary expansion means, the pressure in said intermediate pressure part of the compression element to an optimum intermediate pressure is controlled by adjusting the amount of said first refrigerant stream by controlling said auxiliary expansion means using an expression $$Pint,opt=Kint,opt*GMP=Kint,opt*(Psuc*Pdis)^{0,5},$$

wherein

Pint,opt: Optimum intermediate pressure

Kint,opt: Optimum intermediate pressure coefficient

GMP: Geometric mean of the pressure of the high pressure side and the pressure of the low pressure side Psuc: Pressure of the suction side of the compression element; and Pdis: Pressure of the discharge side of the compression element, and said Optimum intermediate pressure coefficient Kint,opt is set in the range of 1.1 to 1.6.

2. The refrigerating apparatus according to claim 1, wherein the refrigerant used in said refrigeration cycle is carbon dioxide.

3. The refrigerating apparatus according to claim 1, wherein the main expansion means is an expansion valve or a capillary tube.

* * * * *